US005083716A

United States Patent [19]

Colli et al.

[11] Patent Number: 5,083,716

[45] Date of Patent: Jan. 28, 1992

[54] DEVICE AND METHOD FOR AUTOMATICALLY DOFFING BOBBINS IN A WINDING MACHINE

[75] Inventors: Luigi Colli; Roberto Badiali, both of Pordenone, Italy

[73] Assignee: Savio, S.p.A., Pordenone, Italy

[21] Appl. No.: 488,453

[22] Filed: Feb. 26, 1990

Related U.S. Application Data

[63] Continuation-in-part of Ser. No. 155,309, Feb. 12, 1988, abandoned.

[30] Foreign Application Priority Data

Feb. 27, 1987 [IT] Italy ..... 19510 A/87

[51] Int. Cl.[5] ..... B65H 54/26; B65H 67/04

[52] U.S. Cl. ..... 242/35.5 A

[58] Field of Search ..... 242/35.5 A, 35.5 R, 242/18 R, 18 PW

[56] References Cited

U.S. PATENT DOCUMENTS

| | | | |
|---|---|---|---|
| 3,121,540 | 2/1964 | Furst | 242/35.5 R |
| 3,476,328 | 11/1969 | Shimai et al. | 242/35.5 R |
| 3,791,126 | 2/1974 | Kose et al. | 242/35.5 A |
| 3,857,523 | 12/1974 | Lenderman | 242/18 DD |
| 3,940,077 | 2/1976 | Ohashi | 242/35.5 A |
| 3,942,731 | 3/1976 | Lattion | 242/35.5 A X |
| 4,116,395 | 9/1978 | Courvoisier | 242/35.5 A |
| 4,125,990 | 11/1978 | Stahlecker et al. | 242/35.5 A X |
| 4,139,162 | 2/1979 | Stahlecker | 242/35.5 A |
| 4,141,513 | 2/1979 | Miller | 242/18 A |
| 4,178,748 | 12/1979 | Stahlecker et al. | 242/35.5 A X |
| 4,335,859 | 6/1982 | Courvoisier | 242/35.5 A |
| 4,352,466 | 10/1982 | Baumges et al. | 242/35.5 A X |
| 4,399,951 | 8/1983 | Preuhs | 242/35.5 A X |
| 4,534,517 | 8/1985 | Muramatsu et al. | 242/35.5 A |
| 4,591,105 | 5/1986 | Niederer | 242/35.5 A X |
| 4,598,881 | 7/1986 | Lattion | 242/35.5 A |
| 4,638,956 | 1/1987 | Wey | 242/35.5 A |

FOREIGN PATENT DOCUMENTS

| | | | |
|---|---|---|---|
| 0057525 | 8/1982 | European Pat. Off. . | |
| 0126352 | 11/1984 | European Pat. Off. . | |
| 2324411 | 1/1974 | Fed. Rep. of Germany . | |
| 2506291 | 8/1976 | Fed. Rep. of Germany . | |
| 3435951 | 4/1986 | Fed. Rep. of Germany . | |
| 2552745 | 5/1985 | France . | |
| 113662 | 9/1981 | Japan | 242/35.5 A |
| 2001362 | 1/1979 | United Kingdom . | |

*Primary Examiner*—Stanley N. Gilreath
*Attorney, Agent, or Firm*—George P. Hoare, Jr.

[57] ABSTRACT

A device for automatically doffing bobbins which are positioned between holding centers on support arms of a winding machine. The device is on a mobile carriage which patrols along the machine face and comprises an articulated chute shaped member for the guided discharge of the full bobbin from the winding machine, a presentation member to introduce new tubes, a gripper-type manipulation member which withdraws a new tube from the presentation member of the device and positions it between the holding centers on the bobbin support arm, a yarn positioning member which withdraws the yarn from the full bobbin and disposes it on the new tube, and a sliding belt which rotates the new tube to connect the yarn thereto.

15 Claims, 7 Drawing Sheets

Fig.2
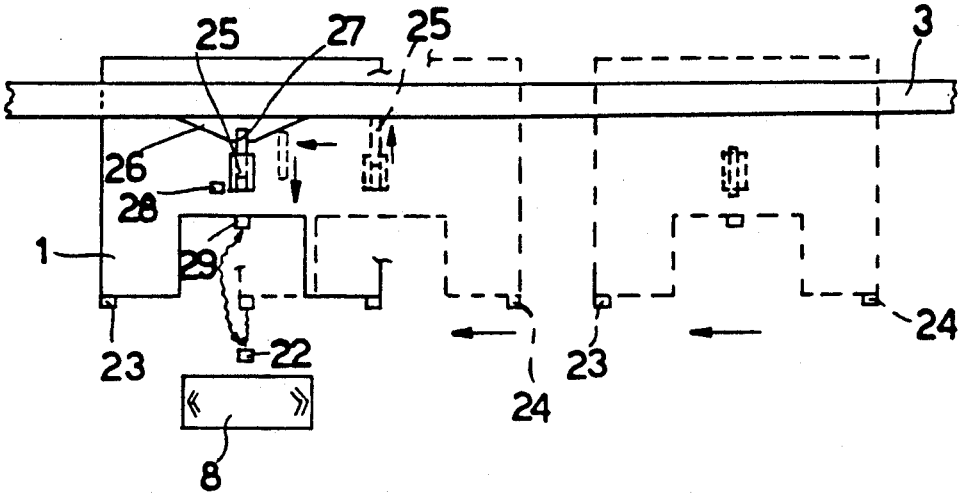
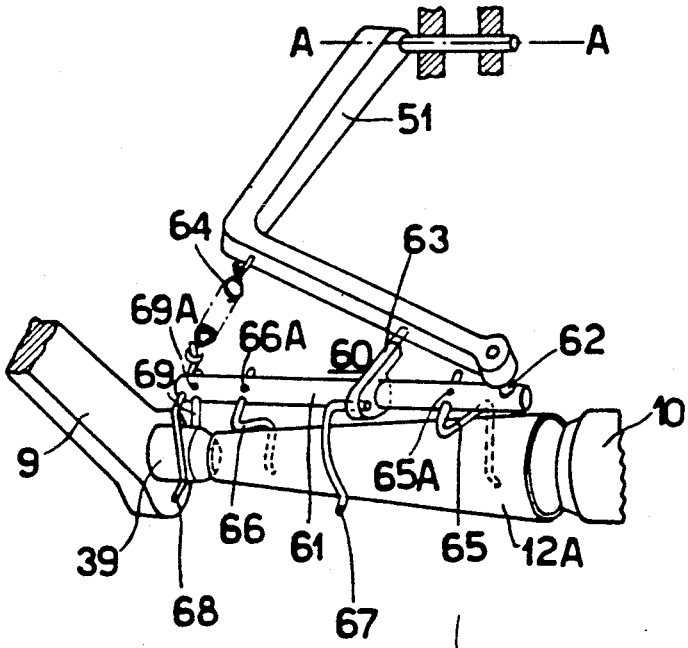
Fig.7A
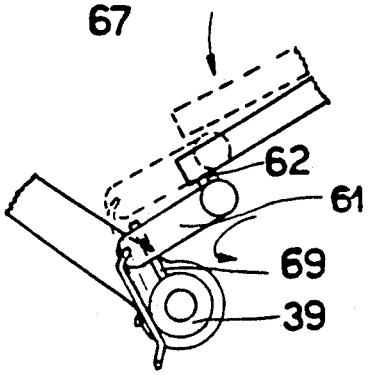
Fig.7B

Fig.3A
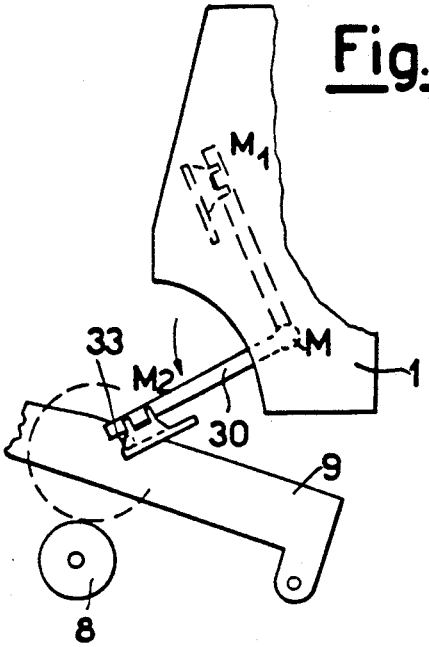
Fig.3B
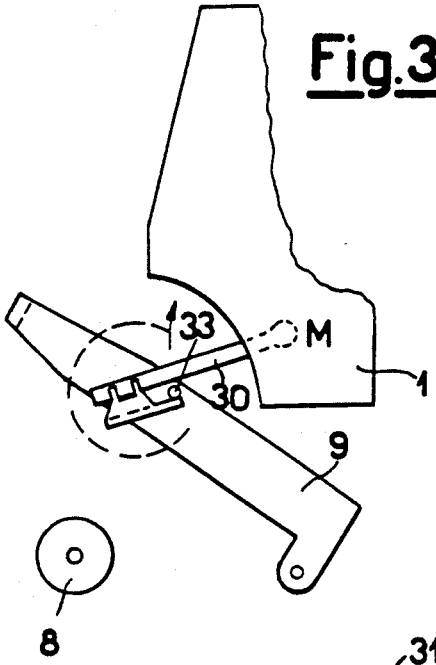
Fig.3C
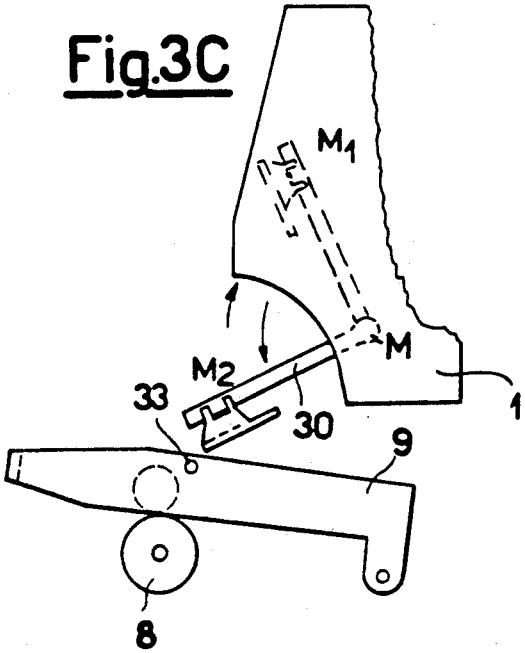
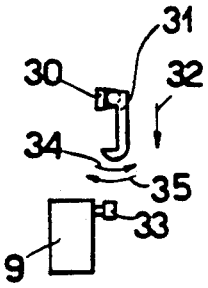
Fig.3D
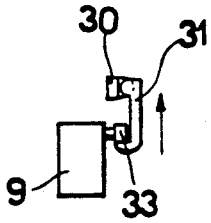
Fig.3E Fig.4A
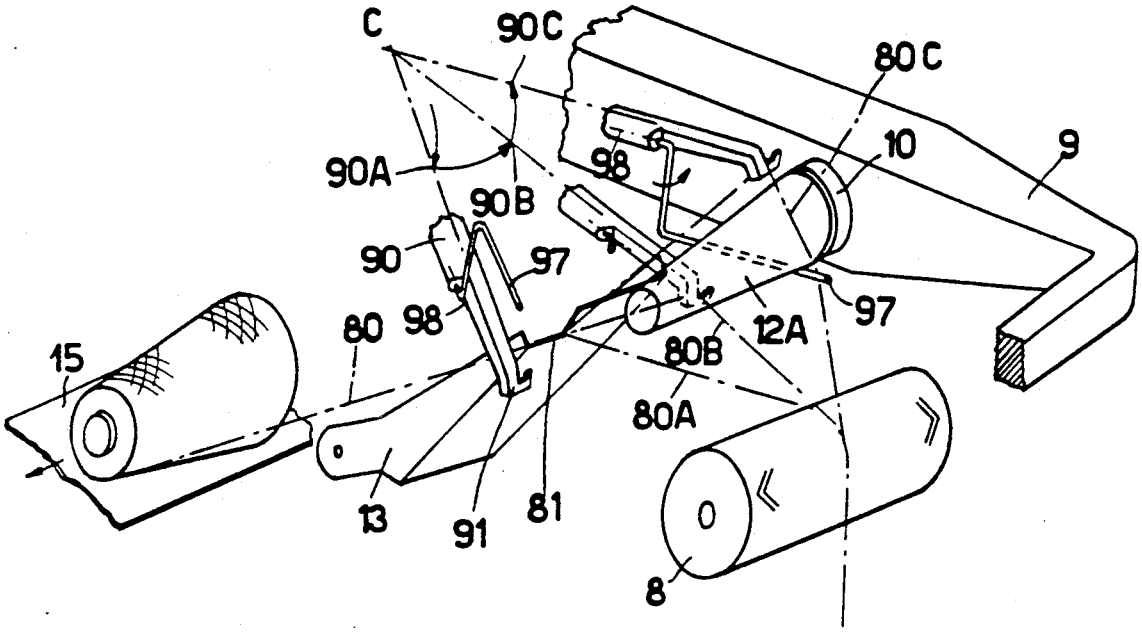
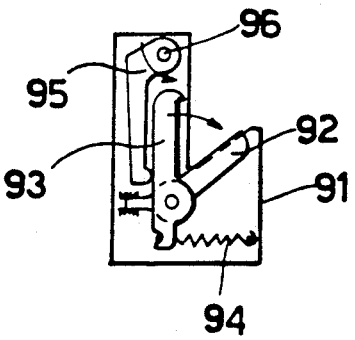
Fig.4B

DEVICE AND METHOD FOR AUTOMATICALLY DOFFING BOBBINS IN A WINDING MACHINE

This invention relates to a device and method for automatically doffing bobbins in a winding machine.

The winding operation is known to consist essentially of withdrawing the yarn from supply packages, eliminating its defects and winding it onto tubes to form bobbins of a predetermined size.

The shape and size of the bobbins generally vary according to the intended use of the yarn. If the yarn is intended to feed high-speed machines, the bobbins are generally cylindrical or frusto-conical with a small taper. If the yarn is intended to feed low-speed machines, the bobbins are frusto-conical with a larger taper. This variable taper is necessary for the correct unwinding of said bobbins during their use, when a more or less substantial centrifugal force is present.

Because of the variable taper and size of the bobbin to be formed, the problems of automating the manipulation of the bobbins and tubes during doffing are very complicated. When the bobbin under formation reaches the required size, the winding head is halted, the bobbin is discharged and is replaced by a new tube on which a new bobbin is built up. The yarn is cut while retaining its tail end, and is then wrapped about the new tube in order to be able to resume winding.

As winding machines comprise a large number of winding heads—for example in straight-line winding machines this number is an average of 48-60 heads per machine—this operation must be automated so that it can be carried out more quickly and reliably without the need for manual intervention by the operators. Briefly, the operational sequence for bobbin doffing is as follows:

- the winding head is halted
- the bobbin support arm is raised from the drive roller
- the full bobbin is doffed from the bobbin support arm and removed
- the new tube is loaded and positioned between the holding centres on the bobbin support arm
- the yarn is connected to the new tube
- the bobbin support arm is lowered
- the winding head is restarted.

The present invention relates to a method and device for automating the overall bobbin doffing operation.

The invention is described hereinafter with reference to the figures, which relate to a typical embodiment thereof.

Figure 1:
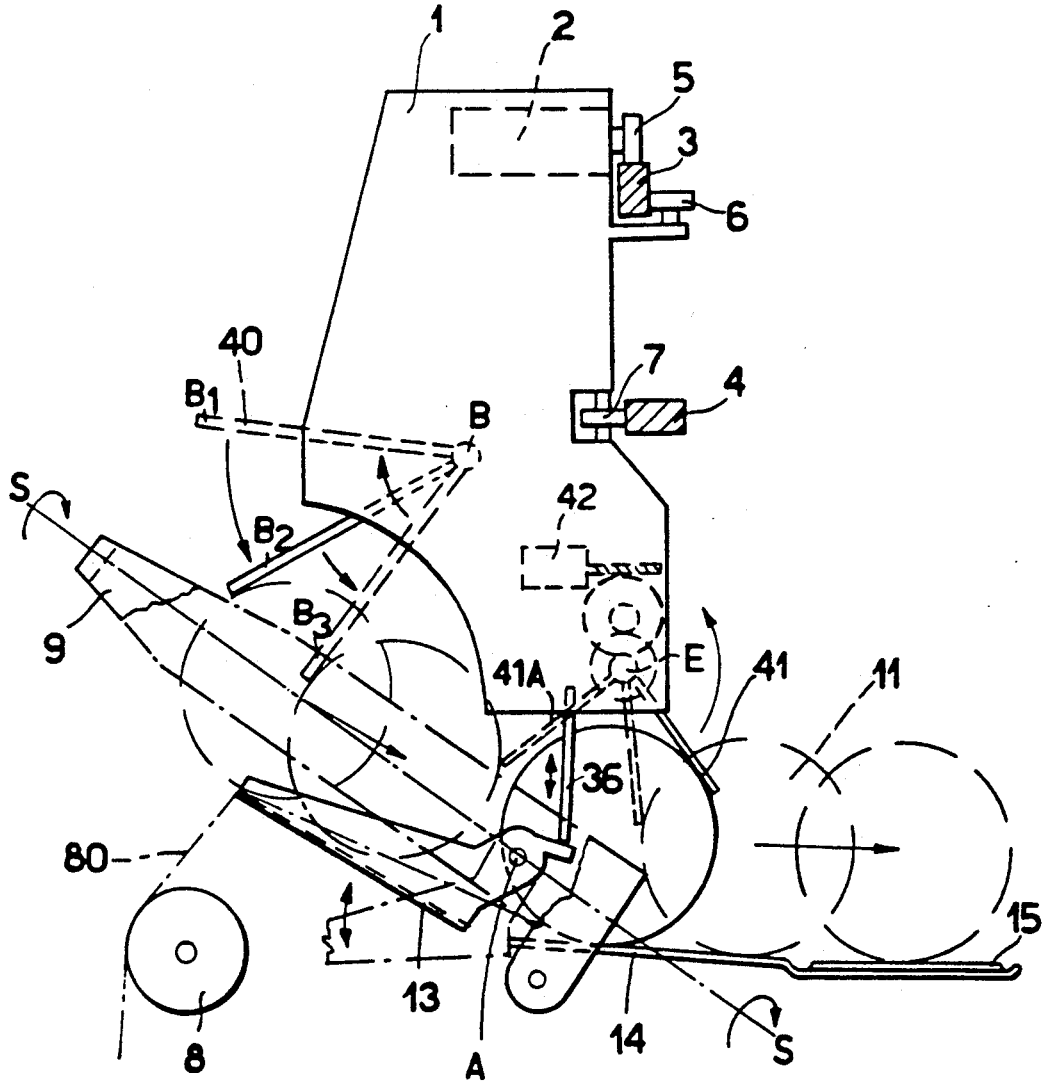

FIG. 1 shows a side view of the carriage and the discharge members for the full bobbin.

FIG. 2 schematically shows a sectional top view of the devices for positioning the carriage in its correct position relative to the winding head.

FIGS. 3A-3E show partial side views of the device for raising the bobbin support arm 9.

FIGS. 4A and 4B orthogonally and schematically show fragmentary side views of the manipulation of the yarn during its seizure from the full bobbin and its control unit its connection to the new tube.

Figure 5A:
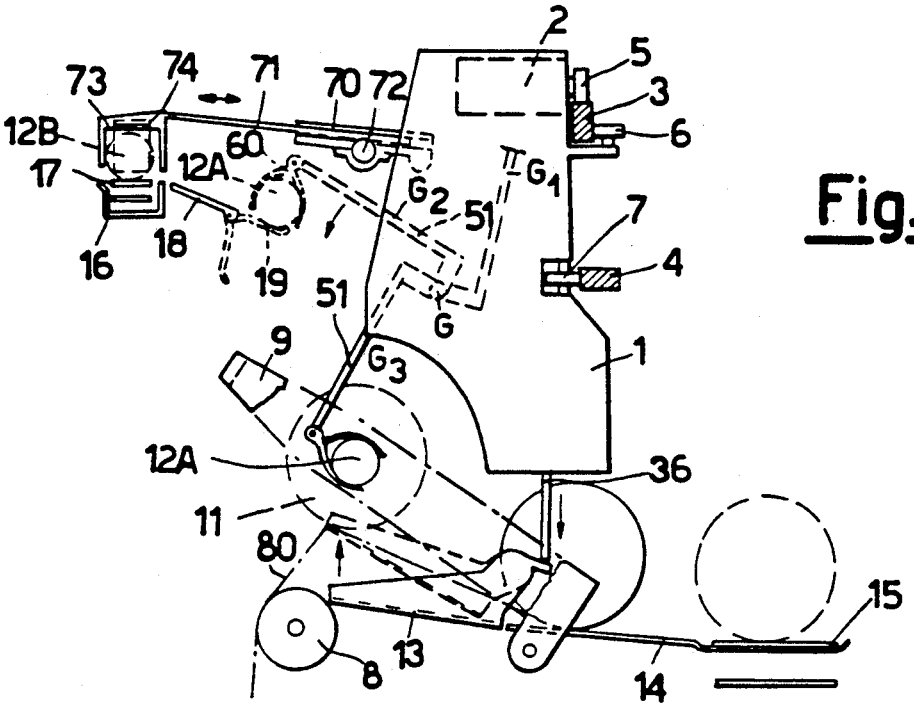
Figure 5B:
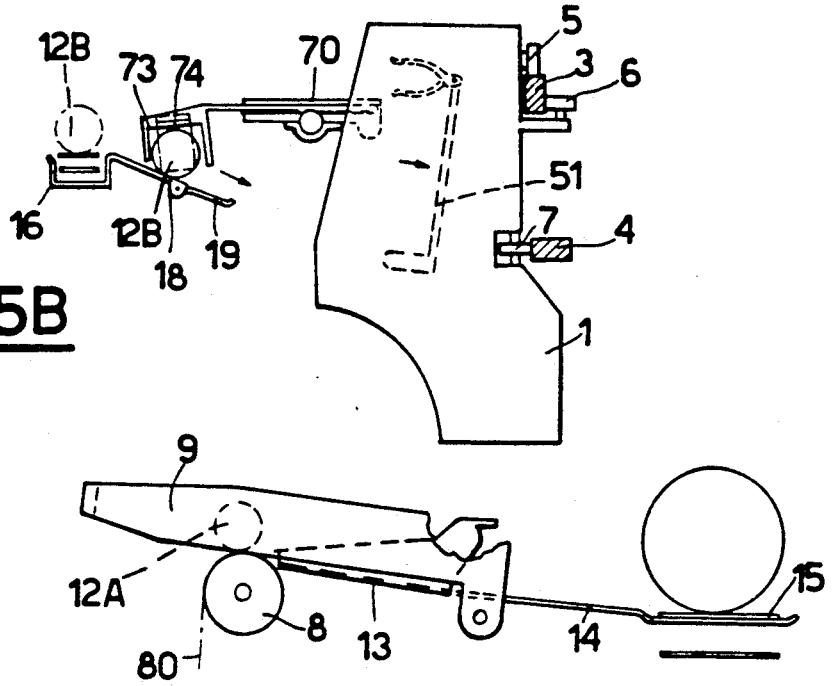

FIGS. 5A and 5B schematically show side views of the manipulation of the new tube.

Figure 6B:
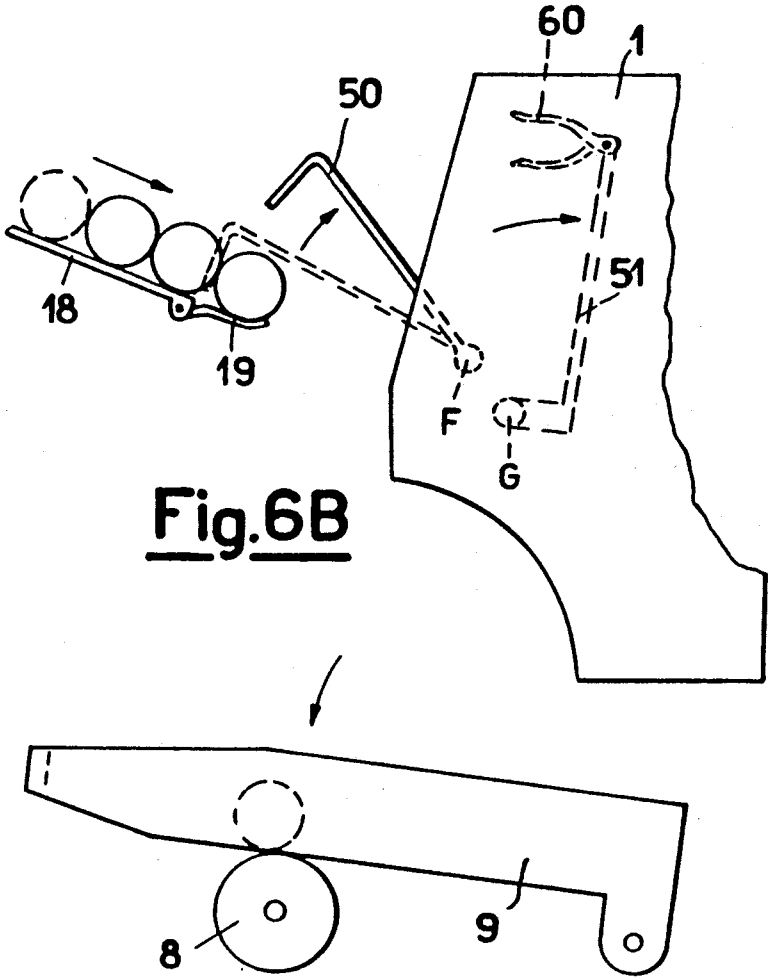
Figure 6A:
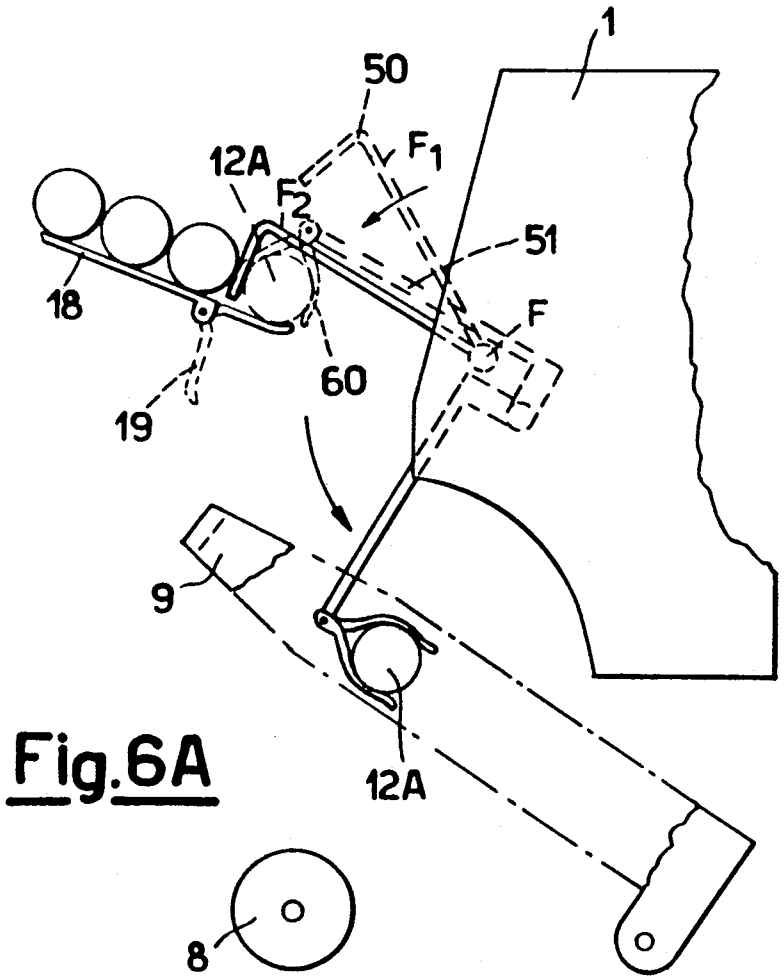

FIGS. 6A and 6B schematically show a side view of a modification of said manipulation.

FIGS. 7A and 7B orthogonally and schematically show the tube manipulation member.

Figure 8A:
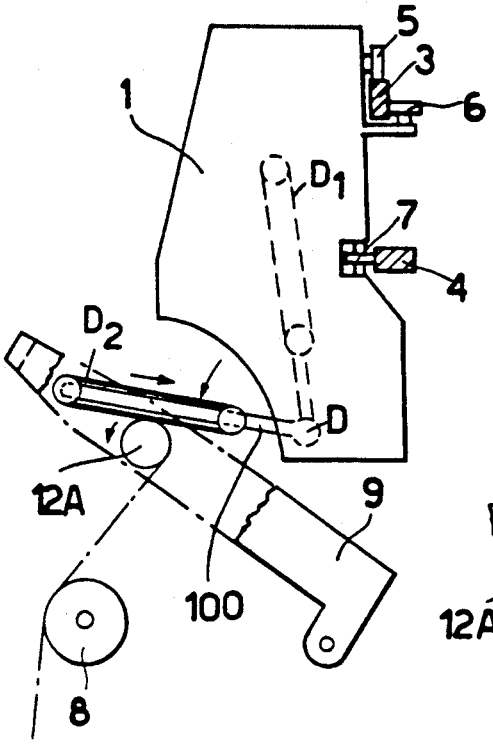
Figure 8B:
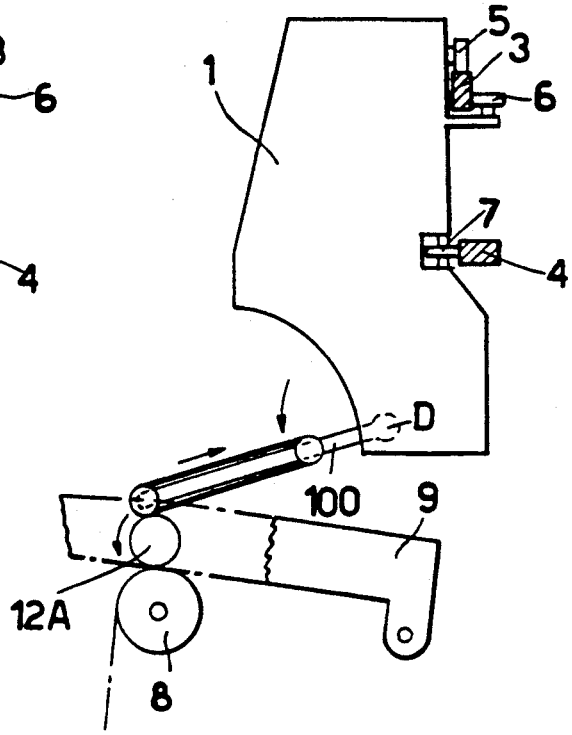
Figure 8C:
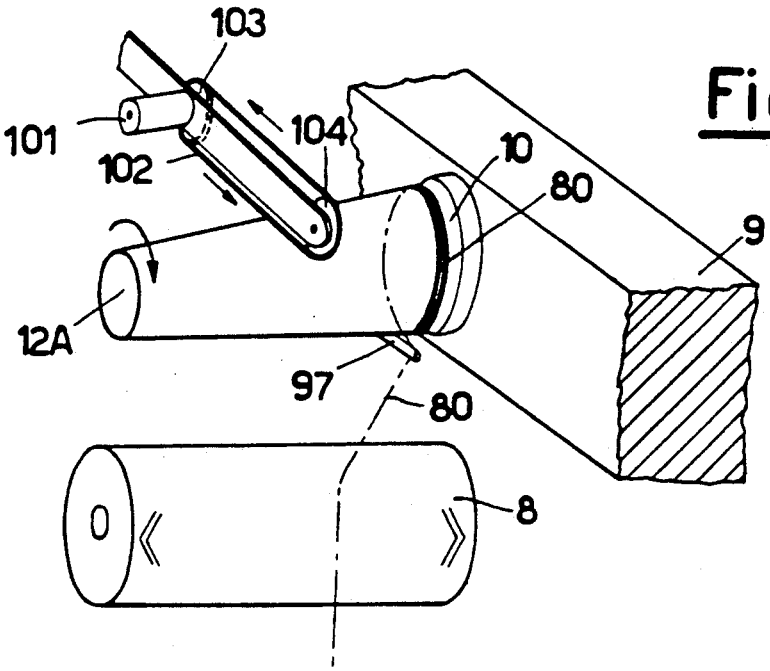

FIGS. 8A-8C orthogonally and schematically show the device for initiating rotation of the tube for the purpose of connecting the yarn.

The device according to the invention consists essentially of a mobile carriage 1 supporting the various members which cooperate in executing the aforesaid operations in a programmed sequence.

In FIG. 1, the device is supported by the mobile carriage 1, which is motorized by the electric motor 2 and runs along the fixed rails 3 and 4 extending along the machine face. The carriage is driven by the drive wheel 5 connected to the motor 2, and is restrained by the idle wheels 6 and 7 which run along the rails 3 and 4 to exactly determine the position of the carriage 1 in the plane of the figure, in known manner.

The winding head i shown diagrammatically in the figures by means of its more important elements such as the bobbin drive roller 8 and the bobbin support arm 9.

In the most common types of winding machines, the bobbin support arm carries at its ends two holding centres such as protrusions 10 and 39 shown in FIG. 7A, of which at least one, indicated by 10, is mobile in an axial direction. Members 10 and 39 represent two opposite centering protrusions for the empty bobbins on respective ends of pivotal arm 9. One of the protrusions (10) also is axially displaceable along an axis which represents the rotational axis of the bobbin, as is known in the art. Such a support means for rotatably holding empty bobbins on which yarn is to be wound is known, for example by Lattion in U.S. Pat. No. 4,598,881.

These holdings centres are made to approach and withdraw from each other to respectively clamp the tube while leaving it free to rotate about its axis, and release it for the doffing and replacement operations. Movements of the centering protrusions 10 and 39 apart and toward each other may be carried out by means of a cam having such a variable profile to approach and withdraw the axially displaceable protrusion in cooperation with a bias spring opposing approaching movements. These means have not been represented in the drawings as they are well known in the art.

The axis through the holding centres is generally not parallel to the axis of the roller 8, but is positioned by adjusting the angle through which the arm 9 is rotated about the axis SS so as to set the two holding centres at different heights according to the taper of the bobbin to be formed and the taper of the tube on which the bobbin is wound.

When a given winding head has completed a bobbin and is halted, it calls the carriage 1 in order to effect the doffing operation. The carriage moves along the rails 3 and 4 driven by the motor 2 in the direction of the "calling" head, which has its photoelectric cell 22 in a central position.

FIG. 2 shows the carriage at the arrival stage. FIG. 2 shows by dashed lines the carriage 1 during the approach stage, and FIG. 2 shows by full lines the carriage when in its operating position.

In the scheme of FIG. 2 the carriage 1 is provided with two photoelectric cells 23 and 24, one of which—according to the direction of movement—passes in front of the photoelectric cell 22 of the "calling" winding head. As soon as the photoelectric cell 23 passes in front of the photoelectric cell 22, the carriage 1 receives a braking command from its photoelectric cell 23, and the lever 25, which is pivoted on the carriage in a position not shown in the figure, is urged by a magnet against the rail 3 which is provided with a fixed cam 26 having a central notch 27 located in correspondence with the centre line of the winding head. During deceleration, the lever 25 rises against the fixed cam 26 and finally becomes wedged in the central notch 27 as the carriage proceeds at very reduced speed. When the lever 25 has entered the notch 27, a probe 28 senses the engagement of the lever 25 and shuts off current to the motor 2.

The photoelectric cell 29—disposed on the carriage centre line—reads the cell 22 to identify the winding head for control purposes. The carriage is positioned and the doffing procedure can be commenced. When doffing is complete, the magnet which urges the lever 25 against the rail 3 is released. The carriage can then be moved into other positions.

When the carriage is positioned, the bobbin support arm 9 is raised. The raising device for the bobbin support arm 9—with reference to FIGS. 3A-3E—consists of an arm 30 pivoted at its centre M to the carriage 1 and provided with a spring hook 31. It descends in the direction 32 rotating about fulcrum M and starting from rest position M1 towards the roller 33 fixed on the bobbin support arm 9. The spring hook 31 rotates about the axis of the arm 30 and snaps over the roller 33 and hooks it by undergoing the rotations 34 and 35. The arm 30 again rises from its hooking position M2 into position M1, dragging the arm 9 into its raised position.

The subsequent operations are carried out with the arm raised, until the yarn has been connected to the tube.

With reference to FIG. 1, the full bobbin 11 is released by the mobile holding centre 10 and fixed holding centre 39, which move apart, and falls onto the mobile chute 13 which is raised pivoting about fulcrum A to receive it. Movement of the chute 13 is controlled by the piston 36 disposed on the carriage 1, which piston moves downwardly. The bobbin then proceeds along the fixed chute 14 towards the conveyor belt 15, which slides along the winding machine to receive the full bobbins.

Because of the taper of the bobbins, their correct rolling towards the belt 15 is preferably assisted by the pivot-mounted levers 40 and 41, the former accompanying and the latter guiding the bobbin. Simultaneously with the raising of the chute 13, the lever 40 rotates about fulcrum B from position B1 to positions B2 and B3, in order to aid movement of the bobbin along the chute 13, while the lever 41 rotates about fulcrum E and moves into the position 41A shown by dashed lines in order to first halt the released bobbin 12 along the chute 13 and then guide it gradually towards conveyor belt 15 by rotating in anti-clockwise direction about fulcrum E. Rotation is controlled by a motor 42.

Lever 40 serves to displace the full bobbin 11 along the movable chute 13 which is raised in an inclined position by member 36. The full bobbin, when released by the centering members 10 and 39 on the raised chute edges of the chute 13 and would become positioned along the chute instead of remaining transverse thereto due to the taper of the bobbin.

Arm 40 drags the full bobbin forward on the chute 13 by rotating counterclockwise as shown in the drawings (FIG. 1) until the bobbin is caused to be stopped by arm 41 in its waiting position 41A. The latter arm is rotated and the bobbin progressively reaches the second chute 14 owing to the inclination of the chute 13. The bobbin is then urged towards the conveyor 15 upon completion of the rotation of the arm 41. Rotational actuation of the arms 40 and 41 may apparently be effected by known mechanical means, for instance by gear means operated by electrical motors with interposition of clutch means.

The levers 40 and 41 are preferably L-shaped and make contact with the bobbin by means of that portion of the L which is perpendicular to the plane of FIG. 1.

This arrangement allows correct discharge of the bobbin —even for higher taper—which guided in this manner does not lie crosswise on the path of the chutes 13 and 14.

According to a modified embodiment, the lever 41 can be formed in such a manner as to make a complete anti-clockwise revolution about its pivot E, so as to firstly retain the bobbin 11 and then accompany it towards the belt 15, this being advantageous if the bobbin has difficulty in proceeding along the chute 14. When the bobbin 11 has been released from the holding centres, a new tube 12A is fed and loaded onto the bobbin support arm 9.

In order to be able to resume winding with the new tube 12A, the yarn originating from the winding head must be seized and controlled during the doffing operation.

With reference to FIGS. 4A and 4B, for this purpose the arm 90 is used, it being pivoted at C and able to rotate in two substantially orthogonal planes. Movement of the arm 90 is clearly indicated in FIG. 4A in that some position of the arm 90 is indicated by a partial representation of the arm itself and by indication of its axis in said position, as well as by arrows indicating rotation, which occurs about center C. Movement of the member 97 is shown and described as occurring about axis 98 which is parallel to the extension of the arm 90. Since these movements are carried out simultaneously, a gear transmission may be provided such that rotation of arm 90 automatically causes rotation of member 97 for instance by providing an arcuate track concentric with center C and engaging a pinion rigid with the portion of member 97 arranged in arm 90. Pivotal movement of arm 90 may be controlled by an electric motor and reduction gear, but any other suitable conventional means could be used.

During the sliding of the bobbin 11 along the chute 13 the yarn is still connected to the bobbin, and forms an angle with the upper edge of the chute 13, which is shaped with a lead-in notch 81 for the yarn, which passes through the position 80A.

The lever 90 is provided with a hook-shaped end part 91 provided with a cutting device, shown in FIG. 4B. The cutting device consists of a fixed cutter 92 and a mobile cutter 93 which are pivoted together to form a scissor member. Said scissor member is opposed by the spring 94 which tends to keep it open, and is operated by a lever 95 controlled by the rotating rod 96 which passes along the body of the arm 90. Said arm 90 is provided with an L-shaped introduction member 97 able to rotate about the axis 98, substantially parallel to the arm 90.

The arm 90 undergoes the sequence of rotations indicated by the arrows; it descends into the position 90A in a substantially vertical plane, then rotates in a plane orthogonal to the preceding (and passing through the centre C and the axis of the drive roller 8) to reach the position 90B so that the hook-shaped end 91 collects the yarn in the position 80A and moves it into the position 80B, after which the arm rises in a substantially vertical plane into the position 90C, so dragging the yarn into the position 80C.

During this operation, the introduction member 97 rotates about its axis 98 to move downwards and urge the yarn 90 in front of the holding centre 10. During this operation, the holding centres are free and are not yet occupied by the new tube 12A.

The loading and positioning of the new tube is effected by the member shown in FIGS. 5A–7B.

The tube presentation member, which constitutes one of the basic constituents of the device, is composed of an articulated chute, which is in the form of a fixed chute 18 provided at that end facing the winding head with a mobile terminal part or arm 19 having a curved edge in the shape of a cradle in order to retain the tube 12A for presentation to the manipulation member.

Said terminal part or arm forms a mobile chute 19, and can assume substantially two positions, namely the tube presentation position, and the disengagement position in which it does not interfere with the manipulation member and enables it to rotate downwards about an axis substantially parallel to the axis of the holding centers on the bobbin support arm in order to move the tube towards the bobbin support arm, in accordance with the dashed-line configuration of FIG. 5A.

The tube presentation member formed from the chutes 18 and 19 can be constructed in two different versions, which are described hereinafter.

The number of chutes provided can be equal to the number of winding heads, each one being positioned in correspondence with the winding head to which it is exclusively assigned as shown in FIG. 5B. Alternatively, it can be mobile and be disposed on the carriage (while maintaining substantially the same configuration and operation) and is able to successively serve all the winding heads, to which it is presented as required by moving the carriage 1 along the machine face, as in FIG. 5A. The tube presentation member can either be engaged by one tube 12A at a time, or can act as a store for a small number of reserve tubes. The two alternative versions are shown schematically in FIGS. 5A and 5B and FIGS. 6A and 6B, of which the operation is described hereinafter.

The tubes can be fed to the presentation member either manually or automatically, this latter being the preferred method, in accordance with the scheme shown by way of the non-limiting example in FIGS. 5A and 5B. A support 16 is fixed along the winding machine face in order to guide a conveyor belt 17 which feeds the tubes to the positions concerned. In correspondence with the winding head, there is disposed the chute 18/19 which has to receive the new tube to be fed during the next operation cycle.

The empty tubes to be fed to the winding machine are released from a store, not shown in the figure, onto the conveyor belt 17 along which they travel, lying down along a generating line, in the direction of motion of the belt, and are distributed by it along the machine face as far as the position into which the tube has to be delivered.

An extendable arm 70 is fixed on the carriage 1 in order to withdraw the new tube 12B from the conveyor belt 17 and deliver it to the chute 18/19. This extendable arm consists of a rack rod 71 operated by a pinion 72 driven by a geared motor, which causes the rod 71 to extend and retract as required. During tube withdrawal, it extends the rod 71 outward until the rake member 73, provided in its closed end with a limit switch 74, straddles (as shown in FIG. 1A) the conveyor belt 17 carrying the new tube 12B. The feed motion of the conveyor belt 17 is controlled by the carriage 1.

As soon as the tube 12B carried out by the belt 17 reaches the rack 73 and presses against the limit switch 74, the arm 70 begins to retract the rake member 73 and rotates slightly downwards, to accompany the tube 12B (as shown in FIG. 5B) along the chute 18/19 until the presentation position constituted by the cradle is reached. Subsequently to the positioning of the tube, the arm 70 carries out a clockwise rotation and disengages from the same tube.

The new tube 12B is positioned only after the tube 12A has been seized and the mobile chute has returned to its presentation position in which it is able to receive the new tube. In this respect, the manipulation arm 51 is shown in its rest position, and the bobbin support arm is shown lowered into its working position.

If the chute 18/19 is engaged by only one tube at a time, as shown in the scheme of FIG. 5A, the procedure for seizing the tube 12A by the manipulation member is as follows.

At the commencement of the procedure, the tube 12A to be seized is positioned in the cradle of the mobile chute 19. The manipulation member is positioned on the carriage 1, and consists essentially of a rotary arm 51 and a gripper member 60—which are described in detail hereinafter with reference to FIGS. 7A and 7B—these being brought into engagement with the tube 12A by rotation about centre G from position G1 to position G2. Arm 51 is pivotable about axis AA (FIG. 7A). Any means suitable for obtaining such a pivotal movement can be utilized, examples of which, such as lever and gear means, are well known in the art.

When the gripper member 60 has gripped the tube 12A in the position G2 shown by dashed lines, the mobile chute 19 is opened preferably by the force of the gripper member 60 and moves into the disengagement position shown by dashed lines. Chute 19 is pivotable about a hinge (unnumbered) at the bottom end of chute 18. The normal position of chute 19, in which it is capable of holding an empty bobbin, is maintained by a pawl which is caused to release the chute 19 when the arm 51 has grasped the empty bobbin and is caused to move downwards. On releasing the chute 19, the same drops under the action of gravity.

The chute 19 is newly brought in normal position by a lever means operated by the arm 51 in is upward movement, the arm also causing the pawl to newly engage the chute once the arm reaches its upper end stroke. It is apparent that mechanical controls like the above described one, which is only an example of many, are well known in the art and need not to be described in detail.

When the chute 19 is in its disengagement position, the arm 51 is free to continue its descent movement towards the bobbin support arm 9, rotating about pivot G, and move into the position G3 as shown by full lines in which the axis of the tube 12A coincides with the axis of the holding centres 10 and 39, which are withdrawn from each other so as to be able to receive the new tube.

When the tube 12A has been correctly positioned, the holding centres 10 and 39 are closed in order to retain it (FIG. 7A). The gripper can then be released and the arm 51 be rotated upwards into its rest position shown in FIG. 5B. The mobile chute 19 is again closed into its presentation position, in which it can receive the next tube 12B.

If the chute 18/19 is engaged by more than one tube at a time, as shown in FIGS. 6A and 6B, the procedure for seizing the tube 12A by the manipulation member is as follows. Four reserve tubes are by way of example shown disposed in the chute 18/19 in FIG. 6A.

In this method of application of the invention, the manipulation device according to the invention is provided with a supplementary separation member which separates the new tube 12A—the first in the row—from the other reserve tubes. It consists of an L-shaped separator lever 50, which by means of a blade formed by its shorter side separates, when rotated about pivot F downwards from position Fl to position F2, the tube 12A from the other tubes lying on the chute and retains these latter on said chute. This is done before operating the arm 51.

The lever 50 is disposed in a position external to the arm 51 so as not to interfere with the movement of this arm or with the gripper 60. Lever 50 is lowered for retaining all the empty bobbins except the first one, by lever means linked to the initial movement of the arm 51, whereas lever 50 is newly raised when the arm 51 returns to the raised rest position. Raising the lever 50 is caused by the movement of the arm 51, when the chute 19 has already been brought in its normal position.

When the tubes have been separated, the manipulation procedure already described heretofore can be effected. When the tube has been positioned between the centres 10 and 39 and these have been approached to retain the tube, the gripper member 60 can be released and the arm 51 can raise into its rest position G1. Subsequently, the separator lever 50 can also raise into its rest position Fl, thus allowing advancing movement of the reserve tubes on the fixed chute 18 and mobile chute 19.

An essential part of the present invention is the manipulation member, which is described with reference to FIGS. 7A and 7B showing a typical non-limiting embodiment thereof.

The manipulation member consists of a gripper member 60 and an arm 51 able to rotate about the axis AA—substantially parallel to the axis of the holding centres—to describe the circular trajectory from the rest position indicated in FIG. 5B to the seizing position for the tube 12A presented on the cradle of the mobile chute 19, and then to the position for positioning the tube on the bobbin support arm, these positions being indicated in FIG. 5A.

The gripper member 60 is formed from a lever 61 which is pivoted on 51 by the pin 62 and is positioned—in angular relationship with the arm 51—such that the locator member 63 rigid with the lever 61 is pressed against the arm 51 by the spring 64. The lever 61 supports the actual gripping elements, known as introduction members, which are at least three in number, and of which at least one opposes the remainder.

The bobbin support arm, indicated by 9, carries the fixed holding centre 39 and the mobile holding centre 10 which is shown in its open position to receive the new tube 12A.

The lever 61 supports the fixed introduction members 65 and 66, the position of which is adjustable by means of the grub screws 65A and 66A, which are adaptable to any diameter and taper of the tube 12A. Said fixed introduction members oppose the spring-loaded introduction member 67 in an intermediate position between them, for example pivoted on the locator member 63.

The described embodiment comprises three introduction members, this being the minimum number required for correct operation.

When the arm 51 is lowered towards the bobbin support arm while carrying the tube 12A, the positioner 68 of the lever 61 straddles the holding centre 39 and causes the lever 61 to rotate slightly about the pin 62—FIG. 7B—to position the top end of the tube on the fixed holding centre 39, whereas the bottom end of the tube lies in proximity to the mobile holding centre 10.

In this respect, it must be noted that the axis of the holding centres on the bobbin support arm 9 is adjusted angularly according to the taper of the bobbins to be handled, and the holding centre 39 can lie at different heights with respect to the mobile holding centre 10. The positioner 68, together with the stop member 69 which is adjustable in height by means of the grub screw 69A, therefore acts as a lead-in for the tube towards the holding centre 39. By adjusting the stop member 69 according to the taper of the tubes to be positioned, the device according to the invention is able to manipulate tubes of variable taper with efficiency and precision.

When the mobile holding centre 10 has clamped the tube 12A against the fixed holding centre 39, the lever 51 rises and the spring-loaded introduction member 67 opens during this rising movement to disengage the tube and leave it held by the arm 9. The tube 12A is gripped in the cradle of the mobile chute 19 by the pressure of the introduction member 67 against the tube, the introduction member opening and embracing the tube 12A to position it between itself and the fixed introduction members 65 and 66 which oppose it. In a modified embodiment, the fixed introduction members 65 and 66 can be replaced by spring-loaded introduction members of a type analogous to the introduction member 67. The new tube 12A has thus been positioned, and as its bottom end comes into engagement with the holding centre 10 it clamps the yarn which has previously been moved into the position 80C and grips it when the mobile holding centre 10 closes to lock the bottom end of the tube 12A.

With reference to FIGS. 4A and 4B, when the holding centre 10 has closed, the cutting device disposed at 91 can be operated. The mobile cutter 93 closes against the fixed cutter 92 to cut the yarn. Cutter 93 is operated by rotation of rod 96 about its own axis. Such a rotation may be performed by a suitable known means provided for causing rotation of a rod.

Of the two yarn tail ends, the end towards the roller 8 is released (it being retained by the holding centre 10) whereas the end towards the bobbin is preferably retained between the two cutters so that it does not interfere with the tube 12A during the yarn connection operation. The arm 90 remains in the position 90C.

With reference to FIGS. 8A–8C, the arm 100 is now lowered about fulcrum D from position D1 to position D2, this arm being pivoted on the carriage 1 by means of the pin D so that it rotates in a plane substantially orthogonal to the axis of the tube 12A and is provided with a motor 101 driving the belt 102 which extends between the drive pulley 103 and driven pulley 104. Lowering of arm 100 is caused by gravity action until belt 102 comes to rest on the empty tube. Raising of the arm 100 is effected by means of a lever system controlled to raise the arm itself. It is not believed that a specific disclosure is necessary because means for controlling pivotable arms are well known in the art.

The belt 102 driven by the motor 101 is brought by the arm 100 into engagement with the tube 12A so making it rotate in the direction of the arrow and collect the yarn 80 in the form of closely adjacent turns on the bottom end of the tube according to the position of the introduction member 97. The number of turns wound depends upon the time of operation of the motor 101.

Driving the tube 12A by means of the belt device is very advantageous in that it can drive the tube for any position of the bobbin support arm 9—as shown in FIGS. 8A and 8B—and its contact is very delicate such that it cannot damage the tube. When the yarn has been connected, the arm 100 returns to its rest position D1 and winding can be resumed.

According to a preferred application of the invention, the full bobbin to be discharged is retained on the discharge chutes 13/14 by the pivot-mounted lever 41, and its yarn end is retained between the two cutters 92/93 until connection has been completed in order to ensure that this yarn end is controlled at all times and does not become entangled in the machine members, with obvious negative consequences.

Only when yarn connection is complete is the bobbin 11 delivered to the belt 15 and removed. The arm 90 then moves from position 90C into the rest position to disengage the introduction member 97.

With reference to FIGS. 3A-3E, the arm 9 is now lowered to move the new yarn-connected tube into contact with the drive roller along a generating line thereof by rotating the lever 30 which from the position shown in FIG. 3B is first lowered to the position shown in FIG. 3C, thus releasing the roller 33 from the spring hook 31. Subsequently, the lever 30 is brought from the position of FIG. 3C to the rest position M1 shown in FIG. 3A. The carriage 1 is moved into a position of non-interference, and winding can be resumed.

For controlling the movements of the various movable elements which do not have their own motor as lever 41, there is provided on the carriage 1 an A.C. motor driving an axis having a plurality of control cams fixed thereon, the cams having a profile and mutual angular arrangement such that by slowly rotating they cause the movement of the various movable elements in a time sequence to obtain the above described sequential operation of these elements. Control cams of this type are well known in this art.

We claim:

1. A device for automatically doffing bobbins positioned between a fixed holding center and a mobile holding center connected to a bobbin support arm of a winding machine having winding heads, wherein the device is supported by a mobile carriage which patrols along the machine face comprising:

an articulated chute member connected to the device to guide and accompany the discharge of a full bobbin from the winding machine;

a tube presentation member connected to the device to introduce new tubes;

a movable gripper-type manipulation member associated with the device to withdraw a new tube from said tube presentation member and to position said new tube between the holding centers on the bobbin support arm;

a yarn position member connected to the device to withdraw yarn from a full bobbin and to connect it to the new tube having an arm comprising a member connected to said yarn positioning member able to rotate in two substantially orthogonal planes for seizing the yarn from the full bobbin, a member connected to said yarn positioning member able to rotate in two substantially orthogonal planes for positioning the yarn on the new tube and a member connected to said yarn positioning member able to rotate in two substantially orthogonal planes to separate the yarn portion wound on said full bobbin from the yarn portion to be wound on said new tube; and a sliding belt connected to the device to connect the yarn to the new tube by rotating the new tube.

2. The device of claim 1, wherein the tube presentation member comprises an articulated chute of which one part is fixed and the other part is mobile and wherein the mobile part is able to assume two positions, said positions being a presentation position in which the tube is presented to said gripper-type manipulation member for said gripper-type manipulation member to receive the tube and the other position being a disengagement position so that said gripper-type manipulation member which received the tube is able to move towards the holding center for engagement of the tube.

3. The device of claim 2, wherein said tube presentation member is installed on the mobile carriage and serves the winding head to which it is presented in cooperation with said gripper-type manipulation member for automatically donning the bobbin on the winding head, and wherein each winding head includes a support arm with spaced apart holding centers for the bobbin.

4. The device of claim 1, wherein said tube presentation member is fixed and positioned in correspondence with the winding head to which it is assigned, the number of said tube presentation members being equal to the number of winding heads of the winding machine.

5. The device of claim 4, further comprising:

a conveyor belt to orient and convey new tubes to the tube presentation member; and a rake-like member which withdraws said new oriented tubes from said conveyor belt and guides them into the chute of the tube presentation member.

6. The device of claim 5, further comprising an automatic tube feeder comprising an extendable rod which is orthogonal to the conveyor belt and to which the rake-like member is attached which draws one tube at a time and accompanies it along the tube presentation member automatically.

7. The device of claim 1, wherein said tube presentation member further comprises an arm able to rotate about an axis substantially parallel to the axis of the holding centers on the bobbin support arm, and wherein said gripper-type manipulation member further comprises introduction members which are supported by a pivoting lever attached to an arm of the gripper-type manipulation member.

8. The device of claim 7, further comprising a positioning member which varies the angle between said pivoting lever and said arm to engage one of the holding centers of the bobbin support arm, said holding center being preferably the fixed holding center.

9. The device of claim 8, wherein three or more introduction members are supported by the pivoting lever and at least one of the three or more introduction members is disposed in an intermediate position with respect to the pivoting lever and is also opposed to the remaining introduction members.

10. The device of claim 9, wherein said pivoting lever has opposing sides, and wherein the introduction members of said gripper-type manipulation member are disposed on one side of the pivoting lever.

11. The device of claim 10, wherein at least one of said introduction members is adjustable to receive tubes of any diameter and taper for securely gripping the tube.

12. The device of claim 1, further comprising a stop member associated with the articulated chute member for discharge of the full bobbin from the winding machine to manipulate bobbins of various tapers, said stop member being adjustable according to the taper of the tube to be manipulated.

13. The device of claim 1, wherein the member to separate the yarn portion on the full bobbin from the yarn portion to be wound on the new tube comprises a hook-shaped end part which comprises a cutting member and further wherein said member for seizing and member for positioning the yarn on the new tube comprises a L-shaped introduction member which is able to rotate about said arm and withdraws and brings the yarn of the full bobbin into a position in front of the mobile holding center of the support arm in order to be clamped between said holding centres and an end of the new tube.

14. The device of claim 1, wherein the sliding belt further comprises two pulleys, an arm which supports said pulleys and a motor driven belt slidable between said pulleys, said arm being able to descend in a plane orthogonal to the new tube axis in order to bring said belt into engagement to rotate the new tube.

15. The device of claim 1, wherein the articulated chute member for discharging the full bobbin further comprises pivot mounted levers which accompany and guide said full bobbin along said chute.

* * * * *